United States Patent [19]

Bares

[11] Patent Number: 4,518,245

[45] Date of Patent: May 21, 1985

[54] DEVELOPMENT SYSTEM USING A THIN LAYER OF MARKING PARTICLES

[75] Inventor: Jan Bares, Webster, N.Y.

[73] Assignee: Xerox Corporation, Stamford, Conn.

[21] Appl. No.: 478,425

[22] Filed: Mar. 24, 1983

[51] Int. Cl.[3] ..... G03G 15/09

[52] U.S. Cl. ..... 355/3 DD; 118/657; 118/658

[58] Field of Search ..... 355/3 R, 3 DD, 14 D; 118/656, 657, 658, 661

[56] References Cited

U.S. PATENT DOCUMENTS 4,267,245 5/1981 Wada ..... 355/3 DD X
4,331,757 5/1982 Tanaka et al. ..... 355/3 DD X
4,370,049 1/1983 Kuge et al. ..... 355/3 DD

*Primary Examiner*—Fred L. Braun
*Attorney, Agent, or Firm*—H. Fleischer; J. E. Beck; R. Zibelli

[57] ABSTRACT

An apparatus in which a latent image recorded on an image receiving member is developed. A metering roller advances marking particles to a developer roller for transportation to the latent image. The thickness of the layer of marking particles on the developer roller is a function of the ratio of the surface speed of the metering roll to developer roll. In this way, a thin layer of marking particles is transported into contact with the latent image to form a powder image on the image receiving member.

32 Claims, 5 Drawing Figures

DEVELOPMENT SYSTEM USING A THIN LAYER OF MARKING PARTICLES

This invention relates generally to an electrophotographic printing machine, and more particularly concerns an apparatus for developing a latent image recorded on a photoconductive surface.

Generally, the process of electrophotographic printing includes charging a photoconductive surface to a substantially uniform potential. The charged portion of the photoconductive surface is exposed to a light image of an original document being reproduced. This records an electrostatic latent image on the photoconductive surface corresponding to the informational areas within the original document. After the electrostatic latent image is recorded on the photoconductive surface, the latent image is developed by bringing a developer material into contact therewith. This forms a toner powder image on the photoconductive surface. Subsequently, the toner powder image is transferred to a copy sheet. Finally, the powder image is heated to permanently affix it to the copy sheet in image configuration.

In the foregoing type of printing machine, a development system is employed to deposit developer material onto the photoconductive surface. Generally, the developer material comprises toner particles, which are mixed with coarser carrier granules. Typical toner particles are made from a thermoplastic material while the carrier granules are made from a ferromagnetic material. Alternatively, single component magnetic particles may be employed. A system utilizing single component magnetic developer material would be capable of high speeds. One type of development apparatus employing a single component magnetic material is described in U.S. Pat. No. 2,846,333, issued to Wilson in 1958. It has been found that uniform metering of the toner particles onto the developer roll places an excessive amount of material thereon. Uniform metering of a thin layer of toner particles, hereinbefore, placed stringent requirements on the mechanical design tolerances of the parts. In order to optimize development of the latent image utilizing insulating, magnetic toner particles, it is desirable to uniformly meter a layer of toner particles of about 1 milligram or less per square centimeter of developer roller surface. Various approaches have been devised for developing the latent image recorded on a photoconductive surface. The following disclosures appear to be relevant:

- U.S. Pat. No. 3,176,652; Patentee: Mott et al.; Issued: Apr. 6, 1965.
- U.S. Pat. No. 3,246,629; Patentee: Shelffo et al.; Issued: Apr. 19, 1966.
- U.S. Pat. No. 3,674,532; Patentee: Morse; Issued: July 4, 1972.
- U.S. Pat. No. 3,863,603; Patentee: Buckley et al.; Issued: Feb. 4, 1975.
- U.S. Pat. No. 4,018,187; Patentee: Abbott et al.; Issued: Apr. 19, 1977.
- U.S. Pat. No. 4,136,637; Patentee: Snelling; Issued: Jan. 30, 1979.

The relevant portions of the foregoing disclosures may be briefly summarized as follows:

Mott et al. describes a magnetic brush apparatus having an elongated magnet held stationarily in a rotating shield. The shield may be plastic with the outer surface thereof roughened in a random or rectangular pattern.

Shelffo et al. discloses a flame spray used to provide a layer of irregularly shaped particles which adhere to the exterior circumferential surface of the developer roller providing a randomly roughened surface.

Morse describes a magnetic brush development system employing a developer roller having the surface thereof grooved with the grooves being parallel to the axis of rotation to facilitate carrying developer along the surface as it rotates.

Buckley et al. describes a magnetic brush developer roller having a resilient roughened polyurethane coating thereon.

Abbott et al. describes a developer roller having a plurality of spaced grooves extending in a direction substantially parallel to the axis of rotation thereof. The depth of the grooves is to a minimum of one to two times the carrier bead diameter while the groove width is a minimum of two to three times the carrier bead diameter. The grooves are spaced in a range of from 15 to 25 times the diameter of the carrier beads. Lands between adjacent grooves are polished to a 25 microinch finish.

Snelling describes a developer roller having a pattern of grooves in the surface thereof. The grooves are shown as either being parallel to the axis of rotation or extending about the circumferential surface along the longitudinal axis of the developer roller.

In accordance with one aspect of the present invention, there is provided an apparatus for developing a latent image recorded on an image receiving member. The apparatus includes a housing defining a chamber for storing a supply of marking particles. Means transport the marking particles from the chamber in the housing into contact with the latent image recorded on the image receiving member. Means are provided for removing marking particles from the transporting means after the transporting means moves the marking particles into contact with the latent image. Means, closely spaced to the transporting means, advance marking particles to the transporting means. The thickness of the layer of marking particles on the transporting means is a function of the ratio of the surface velocity of the advancing means to transporting means. Means regulate the quantity of marking particles being advanced by the advancing means to the transporting means.

Pursuant to another aspect of the present invention, there is provided an electrophotographic printing machine of the type having a photoconductive member arranged to have a latent image recorded thereon. The printing machine includes a housing defining a chamber for storing a supply of marking particles. Means transport the marking particles from the chamber in the housing into contact with the latent image recorded on the photoconductive member. Means remove marking particles from the transporting means after the transporting means move the marking particles into contact with the latent image. Means, closely spaced to the transporting means, advance marking particles to the transporting means. The thickness of the layer of marking particles on the transporting means is a function of the ratio of the surface velocity of the advancing means to transporting means. Means regulate the quantity of marking particles being advanced by the advancing means to the transporting means.

Other aspects of the present invention will become apparent as the following description proceeds and upon reference to the drawings, in which.

While the present invention will hereinafter be described in connection with various preferred embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
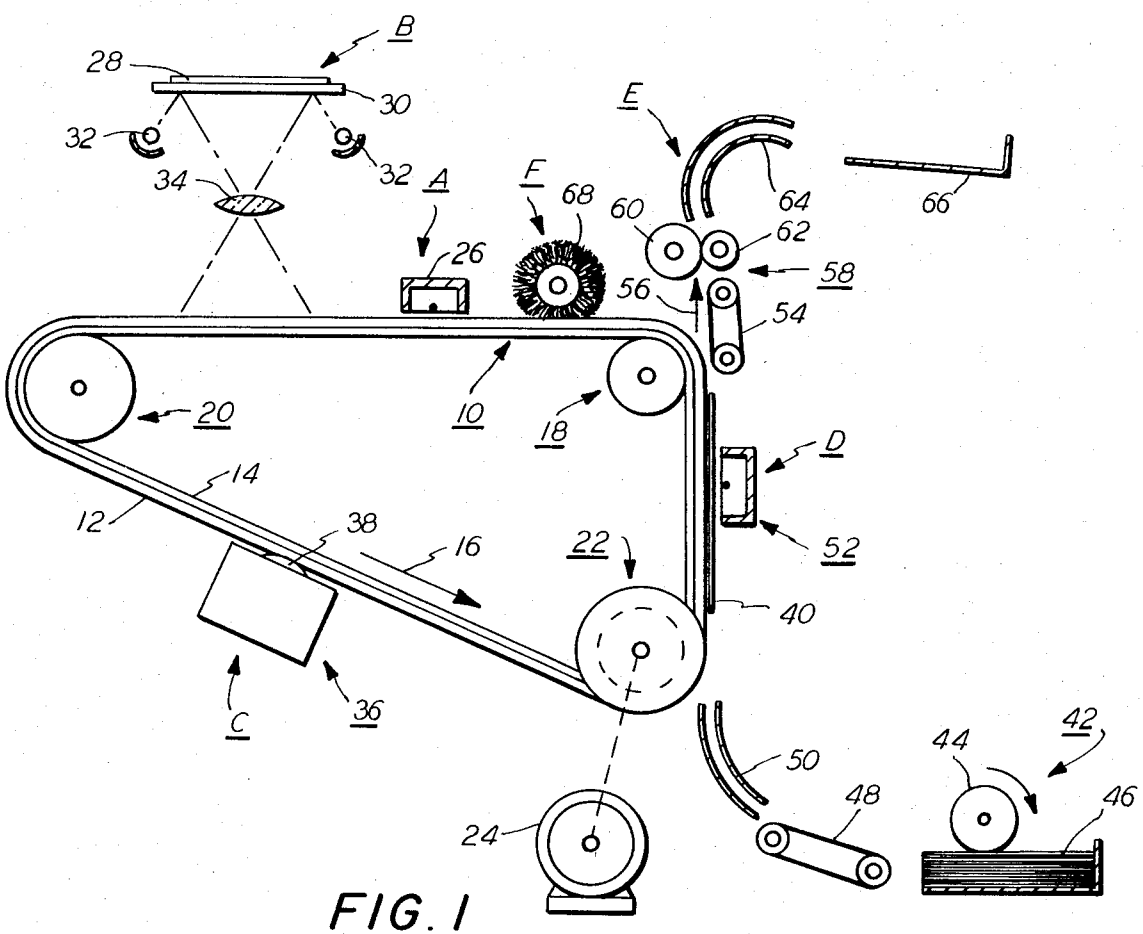
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this apparatus is equally well suited for use in a wide variety of electrostatographic printing machines and is not necessarily limited in its application to the particular embodiments depicted herein.

In the illustrative electrophotograhic printing machine, as shown in FIG. 1, a belt 10 having a photoconductive surface 12 deposited on a conductive substrate 14 moves in the direction of arrow 16. Preferably, the conductive substrate comprises a transparent support such as a poly (ethyleneterpethialate) cellulose acetate or other suitable photographic film supports, typically having coated thereon a transparent conductive coating such as high vacuum evaporated nickel, cuperous iodide, or any suitable conducting polymer. The conductive support is, in turn, overcoated with a photoconductive layer typically comprising a binder and an organic photoconductor. A wide variety of organic photoconductors may be employed. For example, an organic amine photoconductor or a polyarylakene photoconductor may be used. However, one skilled in the art will appreciate that any suitable organic photoconductor compatible with a transparent conductive substrate may be utilized in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the marking particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

Initially, a portion of belt 10 passes through charging station A. At charging station A, a corona generating device, indicated generally by the reference numeral 26, charges photoconductive surface 12 of belt 10 to a relatively high, substantially uniform potential having a negative polarity. One skilled in the art will appreciate that the polarity of the charge imposed upon the photoconductive surface depends upon the selected photoconductor material and a suitable photoconductor material may be utilized wherein a positive polarity is applied rather than a negative polarity.

Next, the charged portion of photoconductive surface 12 advances through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on the photoconductive surface having a negative polarity which corresponds to the informational areas contained within original document 28. Thereafter, belt 10 advances the electrostatic latent image recorded on photoconductive surface 12 to development station C.

At development station C, the magnetic brush development system of the present invention, indicated generally by the reference numeral 36, transports insulating, magnetic marking particles into contact with the latent image recorded on photoconductive surface 12. The force exerted on the marking particles by the electrostatic latent image is greater than the magnetic force exerted thereon attracting the marking particles to developer roller 38. Thus, the marking particles are attracted from developer roller 38 to the latent image forming a powder image on photoconductive surface 12 of belt 10. The detailed structure of development system 36 will be described hereinafter with reference to FIGS. 2 through 5, inclusive.

After development, belt 10 advances the powder image to transfer station D. At transfer station D, a sheet of support material 40 is moved into contact with the powder image. By way of example, the sheet of support material may be paper. The copy paper is advanced to transfer station D by a sheet feeding apparatus, indicated generally by the reference number 42. Preferably, sheet feeding apparatus 42 includes a feed roller 44 contacting the uppermost sheet of stack 46. Feed roll 44 rotates to advance the sheet from stack 46 onto conveyor 48. Conveyor 48 transports the sheet into chute 50 which guides sheet 40 into contact with photoconductive surface 12 of belt 10 in a timed sequence so that the powder image developed thereon contacts the advancing sheet 40 at transfer station D.

Transfer station D includes a corona generating device 52 which sprays negative ions onto the back side of sheet 40. In this way, sheet 40 is charged to an opposite polarity from the marking particles adhering to photoconductive surface 12 of belt 10. The powder image is attracted from photoconductive surface 12 to belt 10.

After the marking particles have been transferred to sheet 40, conveyor 54 advances the sheet in the direction of arrow 56 to fusing station E. Fusing station E includes a fuser assembly, indicated generally by the reference numeral 58, which permanently affixes the transferred powder image to copy sheet 40. Preferably, fuser assembly 58 includes a heated fuser roll 60 and back-up roll 62. Sheet 40 passes between fuser roll 60 and back-up roll 62 with the powder image contacting fuser roller 60. In this manner, the powder image is permanently affixed to sheet 40. After fusing, chute 64 guides the advancing sheet to catch tray 66 for subsequent removal from the printing machine by the operator.

Invariably, after the copy sheet is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 68 in contact with photoconductive surface 12. The pre-clean corona generating device neutralizes the charge attracting the particles to the photoconductive surface. These particles are then cleaned from the photoconductive surface by the rotation of brush 68 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for the purposes of the present application to illustrate the general operation of the illustrative electrophotographic printing machine incorporating the features of the present invention therein.

Figure 2:
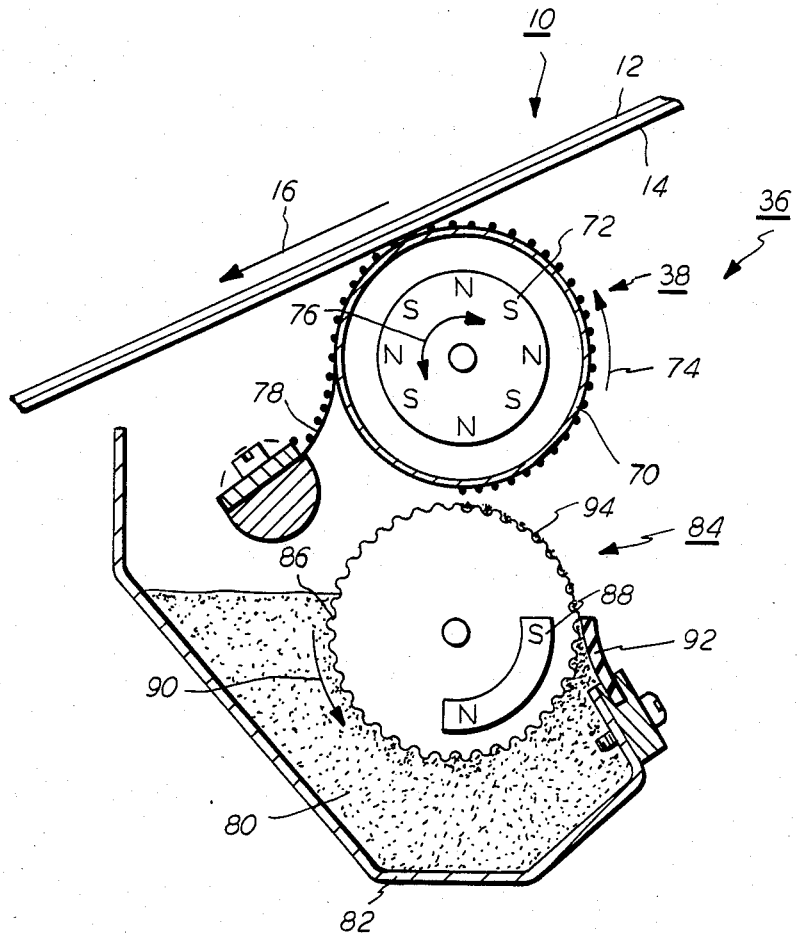
FIG. 2 is an elevational view showing schematically the development apparatus used in the FIG. 1 printing machine.

Referrng now to FIG. 2, there is shown the features of the development apparatus of the present invention in greater detail. As depicted thereat, development apparatus 36 includes a developer roller, indicated generally by the reference numeral 38. Developer roller 38 includes a nonmagnetic tubular member 70. Preferably, tubular member 70 is made from aluminum. Tubular member 70 is interfit telescopically over magnetic member 72. Preferably, magnetic member 72 is made from barium ferrite in the form of a cylindrical member having magnetic poles impressed about the circumferential surface thereof. Belt 10 moves in the direction of arrow 16 at a speed ranging from 2 to 25 inches per second. This selected speed is substantially constant. Tubular member 70 rotates in the direction of arrow 74. In the development zone, i.e. where the marketing particles contact the photoconductive surface of belt 10, the tangential velocity of tubular member 70 is in the same direction as the direction of movement of belt 10. Preferably, the ratio of the tangential velocity of tubular member 70 to the velocity of belt 10 ranges from 2 to 5. Thus, the magnitude of the tangential velocity of tubular member 70 is substantially greater than the velocity of belt 10 while being in the same direction. Magnet 72 rotates in the direction of arrow 76. In this way, magnet 72 rotates either in a direction opposed to that of tubular member 70 or in the same direction. Preferably, magnet 72 rotates at an angular velocity ranging from about 1,000 to about 2,000 revolutions per minute. The selected velocity is constant. By way of example, magnet 72 includes 8 or more magnetic poles. The magnetic field strength of magnet 72 is about 550 gauss. As tubular member 70, insulating magnetic marking particles are transported into contact with the photoconductive surface of belt 10. The marking particles have a charge of at least 1.5 microcoulombs per gram prior to contacting the photoconductive surface of belt 10. If the marking particles are not charged to a sufficient level, a layer of material capable of charging the particles by contact electrification ranging in thickness from 1 micron to 500 microns may be employed to charge the marking particles. By way of example, a polytetrafluoroethylene based resin such as Teflon, a trademark of the DuPont Corporation or a polyvinylidene fluoride based resin such as Kynar, a trademark of the Penwalt Corporation, may be used to charge the marking particles positively. The charge on the surface of tubular member 70 has to be continuously restored by electrical conduction or other suitable means. Therefore, the conductivity of the layer of charging material must be sufficiently high for supply of marking particles. Carbon black is added to the resin of the charging layer for this purpose. The thickness of the brush of marking particles adhering to tubular member 70 is equal to or less than 50 microns. The marking particles are charged to a level such that the magnetic force attracting the marking particles to the surface of tubular member 70 is less than the electrostatic force generated by the latent image recorded on the photoconductive surface of belt 10. In this way, the marking particles are attracted from tubular member 70 to the latent image forming a powder image thereon. A flexible blade 78 has the free end portion thereof in contact with tubular member 70 to scrape the unused marking particles from tubular member 70. Blade 78 is adjustable so that the free end portion thereof is maintained in contact with tubular member 70. By way of example, blade 78 may be made from a suitable spring steel. The marking particles are advanced to tubular member 70 from chamber 80 of housing 82 by a metering roller, indicated generally by the reference numeral 84. Metering roller 84 includes a metering sleeve 86. Preferably, metering sleeve 86 is non-magnetic and made from stainless steel. A plurality of depressed regions are disposed on the exterior circumferential surface thereof for transporting the marking particles from chamber 80 of housing 82 to developer roller 38. Magnet 88 is positioned interiorly of and spaced from sleeve 86. Preferably, magnet 88 is stationary and positioned such that the marking particles in chamber 80 of housing 82 are attracted to the exterior circumferential surface of sleeve 86. Sleeve 86 rotates in the direction of arrow 90. Magnet 88 extends only over an arcuate region sufficient to attract the marking particles to the region of sleeve 86 spaced from developer roller 38. This enables the marking particles to be easily transferred from the metering roller to the developer roller. Sleeve 86 is spaced from tubular member 70, a distance of about 1 millimeter. As shown, sleeve 86 rotates in a direction opposed to tubular member 70. However, a suitable configuration may be developed in which they rotate in the same direction. The magnitude of the angular velocity of sleeve 86 is less than the magnitude of the angular velocity of tubular member 70. A metering blade 92 having the free end portion thereof contacting sleeve 86 regulates the quantity of marking particles being transported by sleeve 86 to tubular member 70. Preferably, metering blade 92 is flexible and made from spring steel.

Figure 3:
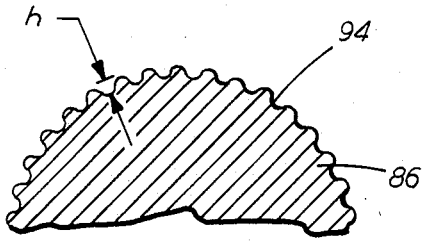
FIG. 3 is a sectional elevational view of the metering roller illustrating the depressions therein.

Turning now to FIG. 3, there is shown a fragmentary, sectional view of sleeve 86. As illustrated thereat, sleeve 86 includes a plurality of depressions 94, each depression is substantially equally spaced and of the same width and height. Thus, the height, h, is about 0.3 millimeters with the width of each depression 94 being about 0.6 millimeters. The edges of depressions 94 are rounded or polished to prevent abrasion of the metering.

Figure 4:
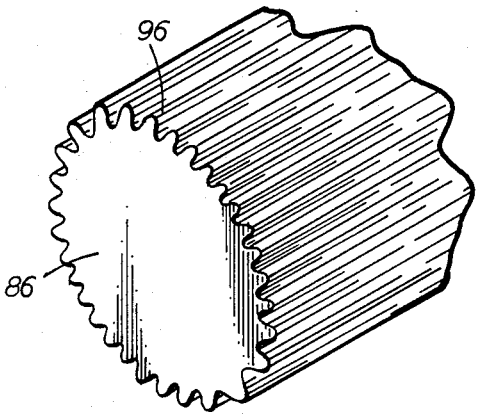
FIG. 4 is a fragmentary, perspective view showing one embodiment of the metering roller employed in the FIG. 2 development apparatus.

Referring now to FIG. 4, sleeve 86 is depicted thereat as including a plurality of grooves 96. Each of these grooves corresponds to the depressions illustrated in FIG. 3. The width of groove 96 is substantially several times greater than the depth thereof. By way of example, the width is preferably about 0.7 millimeters. Each groove is substantially equally spaced from the next adjacent groove. The edges of the grooves are rounded or polished to prevent abrasion of the metering blade.

Figure 5:
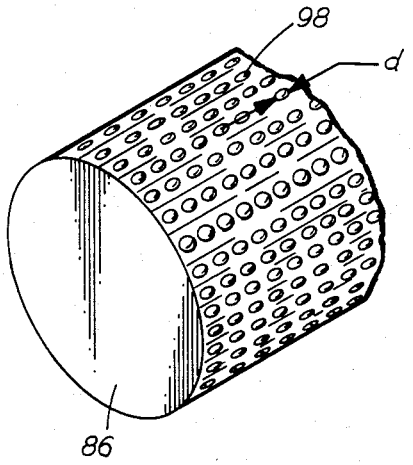
FIG. 5 is a fragmentary, perspective view depicting another embodiment of the metering roller used in the FIG. 2 development system.

Turning now to FIG. 5, there is shown another embodiment of sleeve 86. As depicted thereat, sleeve 86 includes a plurality of circular depressions 98. Each depression 98 has a diameter d thereof. Preferably, the diameter of depression 98 is several times greater than the depth. The diameter d of depressions 98 is preferably about 0.8 millimeters.

The surface velocity of the metering sleeve 86 is such that it furnishes sufficient marking particles to form a layer of marking particles on tubular member 70. Ultimately, the layer of marking particles on tubular member 70 must be sufficient to develop the latent image recorded on photoconductive surface 12. To fully develop one square centimeter of area of the latent image, metering sleeve 86 must supply marking particles at a rate of:

$$R=(m)(V_p)$$

Where:

R = the rate at which the marking particles are furnished;

m = the mass of marking particles per square centimeter; and $V_p$ = the velocity of the photoconductive surface.

In order to provide this rate of marking particles, the metering sleeve 86 must have a surface velocity of:

$$V_s = (K)\frac{(m)(V_p)}{M}$$

Where:

$V_s$ = the surface velocity of metering sleeve 86;

M = the mass of marking particles held in the depressions on one square centimeter of the metering sleeve 86; and K = an efficiency factor, a little greater than one, since not all of the marking particles furnished are necessarily used during development.

Hence, the volume of the depressions on metering sleeve 86, its surface speed, and the speed of the photoconductive surface are all inter-related.

In an alternate embodiment, metering sleeve 86 is smooth or has a surface finish less than about 100 microinches. Metering blade 92 is spaced about 1 millimeter from the surface of sleeve 86. Now, M is the mass of marking particles per square centimeter of surface area of sleeve 86. Once again, the required surface velocity of metering sleeve 86 is $$V_s = (K)\frac{(m)(V_p)}{M}$$

The thickness of the layer of marking particles on tubular member 70 is proportional to the ratio of the surface velocity of the metering sleeve to the surface velocity of the tubular member. Thus, the thickness of the layer of marking particles on tubular member 70 may be expressed as:

$$T_r = \left(\frac{V_s}{V_r}\right)(T_s)$$

Where:

$T_r$ = the thickness of the layer of marking particles on the tubular member;

$T_s$ = the thickness of the layer of marking particles on the metering sleeve; and $V_r$ = the surface velocity of tubular member 70.

In the case of a smooth roll, $T_s$ corresponds to the space between the free end of metering blade 92 and sleeve 86. The term $T_s$, where sleeve 86 has depressions, may be determined from M. The equations for $V_s$ and $T_r$ represent, in essence, the principal of mass conservation along the supply route from chamber 80 to photoconductive surface 12. It should be noted that the velocity of transport of the marking particles around tubular member 70 may not coincide exactly with the surface velocity of tubular member 70. This is due to the action exerted by the rotating magnet 72 disposed interiorly of tubular member 70.

In all cases, the ratio of the surface velocity of the metering sleeve to the surface velocity of the tubular member provides for the precise metering of a thin layer of marking particles onto the surface of the tubular member. This is achieved with the metering blade being spaced a relatively large distance from the surface of the metering sleeve or in contact therewith. Under these circumstances, the tight tolerances and high costs associated with maintaining the metering blade closely spaced to the metering sleeve, i.e. a distance of about 50 microns, is eliminated.

By way of example, the insulating magnetic marking particles may comprise magnetite particles dispersed in an insulating resin. The magnetite comprises 40 to 50 percent by weight of the marking particle with the resin being the remainder of the weight thereof. Any suitable insulating resin typically employed for developer materials used in electrophotographic printing machines of the type hereinbefore described may be utilized.

In recapitulation, the development apparatus of the present invention includes a metering roller for advancing a defined amount of insulating, magnetic marking particles at a constant feed rate to a developer roller. The developer roller forms a thin brush of marking particles which is transported into contact with the electrostatic latent image recorded on a photoconductive surface. The electrostatic latent image attracts the marking particles from the developer roller forming a powder image thereon. In order to control the thickness of the layer of marking particles being transported into contact with the latent image, the thickness of the layer of marking particles on the metering roller and the ratio of the surface velocities of the metering roll to developer roll is precisely controlled. In single component development, a thin magnetic brush significantly improves the powder image formed on the photoconductive surface to optimize copy quality.

It is, therefore, evident that there has been provided in accordance with the present invention, an apparatus for developing an electrostatic latent image that fully satisfies the object, aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image recorded on an image receiving member, including:

a housing defining a chamber for storing a supply of marking particles;

means for transporting the marking particles into contact with the latent image recorded on the image receiving member, said transporting means comprising a tubular member and an elongated magnetic member disposed interiorly of and spaced from said tubular member for attracting the marking particles to the surface of said tubular member;

means for removing marking particles from said tubular member after the marking particles contact the latent image;

means, closely spaced to said tubular member, for advancing the marking particles from the chamber of said housing to said tubular member, said advancing means comprising a metering tube having a plurality of spaced depressions in the exterior surface thereof for receiving the marking particles therein and a metering magnet disposed interiorly of and spaced from said metering tube for attracting marking particles from the chamber of said housing to said metering tube, said tubular member forming a layer of marking particles having a thickness which is a function of the ratio of the surface velocity of said metering tube to the surface velocity of said tubular member; and means for regulating the quantity of marking particles being advanced by said metering tube to said tubular member.

2. An apparatus according to claim 1, wherein said transporting means includes:

means for rotating said tubular member; and means for rotating said magnetic member.

3. An apparatus according to claim 2, wherein said tubular member includes a layer of material on the exterior surface thereof for charging the marking particles.

4. An apparatus according to claim 3, wherein the thickness of the layer of said charging material ranges from about 1 micron to about 500 microns.

5. An apparatus according to claim 3, wherein the marking particles have a charge of at least 1.5 microcoulombs per gram before contacting the latent image recorded on the image receiving member.

6. An apparatus according to claim 3, wherein the charge on the marking particles contacting the latent image recorded on the image receiving member is such that the magnet force attracting the marking particles to said tubular member by said magnetic member is less than the attractive force of the latent image recorded on said image receiving member.

7. An apparatus according to claim 2, wherein the image receiving member moves with the tangential velocity thereof being in the same direction and of a magnitude less than the tangential velocity of said tubular member in the region in which the marking particles contact the image receiving member.

8. An apparatus according to claim 7, wherein the ratio of the velocity of the tubular member to the velocity of the image receiving member ranges from about 2 to 5.

9. An apparatus according to claim 7, wherein said magnetic rotating means rotates said magnetic member at an angular velocity ranging from 1000 to 2000 revolutions per minute.

10. An apparatus according to claim 7, wherein said magnetic member generates a magnetic field having a strength of about 550 gauss.

11. An apparatus according to claim 7, wherein the thickness of the layer of marking particles adhering to said tubular member, in at least the region thereof contacting the latent image recorded on the image receiving member, is about 50 microns.

12. An apparatus according to claim 11, wherein said advancing means includes means for rotating said metering tube.

13. An apparatus according to claim 12, wherein said metering tube is spaced about 1 millimeter from said tubular member.

14. An apparatus according to claim 12, wherein the depressions in the surface of said advancing means are grooves.

15. An apparatus according to claim 12, wherein the edges of the depressions in the surface of said advancing means are grooves.

16. An apparatus according to claim 12, wherein the edges of the depressions in the surface of said advancing means are rounded.

17. An electrophotographic printing machine of the type having a photoconductive member arranged to have a latent image recorded thereon, wherein the improvement includes:

a housing defining a chamber for storing a supply of marking particles;

means for transporting the marking particles into contact with the latent image recorded on the photoconductive member, said transporting means comprising a tubular member and an elongated magnetic member disposed interiorly of and spaced from said tubular member for attracting the marking particles to the surface of said tubular member;

means for removing marking particles from said tubular member after the marking particles contact the latent image;

means, closely spaced to said tubular member, for advancing the marking particles from the chamber of said housing to said tubular member, said advancing means comprising a metering tube having a plurality of spaced depressions in the exterior surface thereof for receiving the marking particles therein and a metering magnet disposed interiorly of and spaced from said metering tube for attracting marking particles from the chamber of said housing to said metering tube, said tubular member forming a layer of marking particles having a thickness which is a function of the ratio of the surface velocity of said metering tube to the surface velocity of said tubular member; and means for regulating the quantity of marking particles being advanced by said metering tube to said tubular member.

18. A printing machine according to claim 17, wherein said transporting means includes:

means for rotating said tubular member; and means for rotating said magnetic member.

19. A printing machine according to claim 18, wherein the photoconductive member moves with the tangential velocity thereof being in the same direction and of a magnitude less than the tangential velocity of said tubular member in the region in which the marking particles contact the photoconductive member.

20. A printing machine according to claim 19, wherein said tubular member includes a layer of material on the exterior surface thereof for charging the marking particles.

21. A printing machine according to claim 20, wherein the thickness of the layer of said charging material ranges from about 1 micron to about 500 microns.

22. A printing machine according to claim 20, wherein the marking particles have a charge of at least 1.5 microcoulombs per gram before contacting the latent image recorded on the photoconductive member.

23. A printing machine according to claim 20, wherein the charge on the marking particles contacting the latent image recorded on the photoconductive member is such that the magnet force attracting the marking particles to said tubular member by said magnetic member is less than the attractive force of the latent image recorded on said photoconductive member.

24. A printing machine according to claim 19, wherein the ratio of the velocity of the tubular member to the velocity of the photoconductive member ranges from about 2 to 5.

25. A printing machine according to claim 19, wherein said magnetic rotating means rotates said magnetic member at an angular velocity ranging from 1000 to 2000 revolutions per minute.

26. A printing machine according to claim 19, wherein said magnetic member generates a magnetic field having a strength of about 550 gauss.

27. A printing machine according to claim 19, wherein the thickness of the layer of marking particles adhering to said tubular member, in at least the region thereof contacting the latent image recorded on the photoconductive member is about 50 microns.

28. A printing machine according to claim 27, wherein said advancing means includes means for rotating said metering tube.

29. A printing machine according to claim 28, wherein said metering tube is spaced about 1 millimeter from said tubular member.

30. A printing machine according to claim 28, wherein the depressions in the surface of said advancing means are substantially hemispherical.

31. A printing machine according to claim 28, wherein the depressions in the surface of said advancing means are grooves.

32. A printing machine according to claim 28, wherein the edges of the depressions in the surface of said advancing means are rounded.

* * * * *